US008118943B2

(12) United States Patent
Erlich et al.

(10) Patent No.: US 8,118,943 B2
(45) Date of Patent: Feb. 21, 2012

(54) DIRECTIONAL CONTROL FOR DUAL BRUSH ROBOTIC POOL CLEANERS

(75) Inventors: Giora Erlich, North Caldwell, NJ (US); Tibor Horvath, Estero, FL (US)

(73) Assignee: Aqua Products, Inc., Cedar Grove, NJ (US)

( * ) Notice: Subject to any disclaimer, the term of this patent is extended or adjusted under 35 U.S.C. 154(b) by 0 days.

(21) Appl. No.: 12/942,390

(22) Filed: Nov. 9, 2010

(65) Prior Publication Data

US 2011/0067729 A1 Mar. 24, 2011

Related U.S. Application Data

(62) Division of application No. 10/542,158, filed as application No. PCT/US2004/037148 on Nov. 4, 2004, now Pat. No. 7,849,547.

(60) Provisional application No. 60/517,352, filed on Nov. 4, 2003.

(51) Int. Cl.
*B08B 7/04* (2006.01)
*B08B 1/00* (2006.01)

(52) U.S. Cl. ..... 134/18; 134/6; 134/8; 15/1.7; 15/49.1

(58) Field of Classification Search ..... 134/6, 8, 134/18; 15/1.7, 49.1
See application file for complete search history.

(56) References Cited

U.S. PATENT DOCUMENTS 2,284,070 A 5/1942 Roof
2,329,153 A * 9/1943 Bromley et al. ..... 464/59
2,640,338 A * 6/1953 Charvat ..... 66/153
4,786,334 A * 11/1988 Nystrom ..... 134/21
5,074,825 A 12/1991 Hamasaki et al.
5,256,207 A 10/1993 Sommer
5,569,371 A * 10/1996 Perling ..... 210/85
6,299,699 B1 * 10/2001 Porat et al. ..... 134/6
6,309,468 B1 * 10/2001 Sommer ..... 134/18
2004/0045104 A1 3/2004 Pichon

* cited by examiner

*Primary Examiner* — Michael Barr
*Assistant Examiner* — Saeed T Chaudhry
(74) *Attorney, Agent, or Firm* — Abelman, Frayne & Schwab

(57) ABSTRACT

A self-propelled robotic pool cleaner (100) has a first pair of driven brushes (12, 14) and second pair of free brushes co-axially mounted for rotation on axles (16) at the opposite ends of the pool cleaner that are transverse to the direction of movement. The first pair of brushes are mounted on one side and are driven by a drive motor (110); the second pair of brushes are mounted on the opposite side of the cleaner. A rotational delay clutch (30) is co-axially positioned between each pair of the first and second brushes so that reversing the drive motor causes the first pair of driven brushes to temporarily rotate at an angular rotational velocity that is greater than that of the second pair of brushes, thereby pivoting the pool cleaner through a predetermined angular change in direction before the synchronous rotation of the second pair of dual brushes is initiated by the engagement of the clutch. Following each reversal, the pool cleaner moves in a new direction along a generally straight path that is angularly displaced from its prior path. A highly efficient cleaning program permits the use of a battery to power the drive and water pump motors in pool cleaners that ascend the side walls as well as cleaning the bottom surface.

17 Claims, 9 Drawing Sheets

FIG. 6
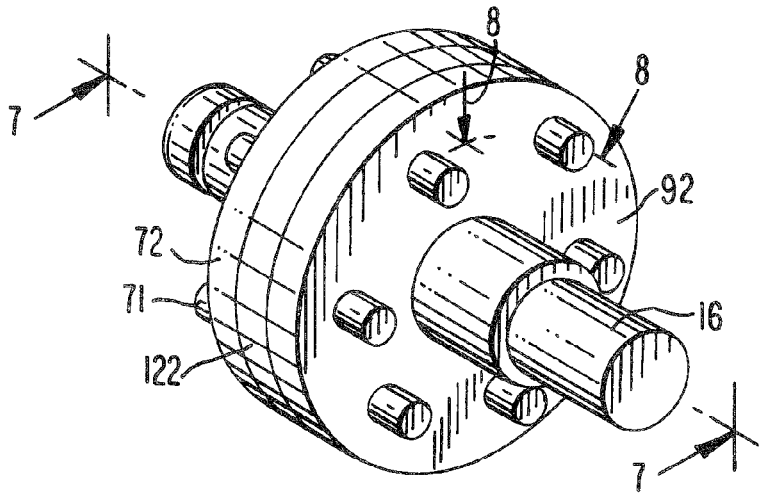
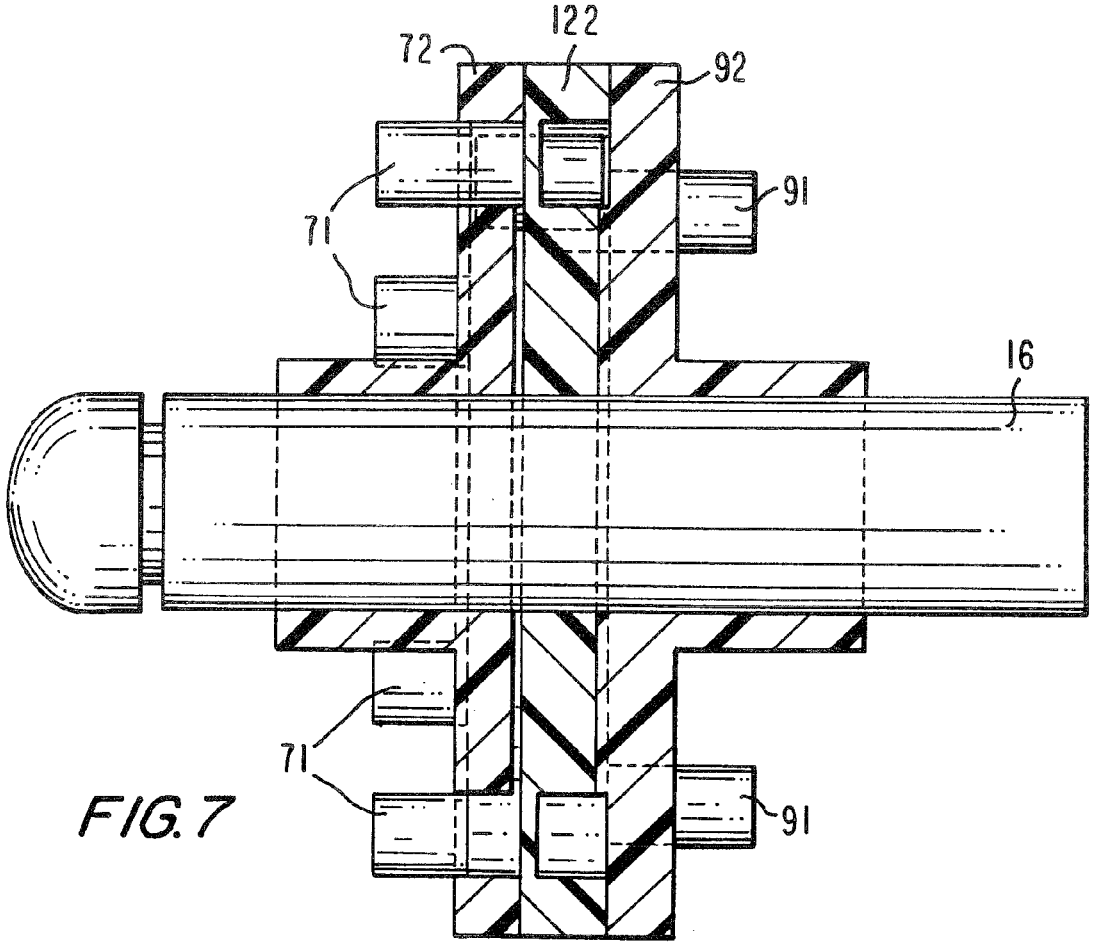
FIG. 7

DIRECTIONAL CONTROL FOR DUAL BRUSH ROBOTIC POOL CLEANERS

CROSS REFERENCE TO RELATED APPLICATION

This application is a divisional of U.S. application Ser. No. 10/542,158 now U.S. Pat. No. 7,849,547, which was the National Stage of International Application No. PCT/US2004/037148, filed on Nov. 4, 2004, which claims the benefit of U.S. Provisional Application No. 60/517,352, filed Nov. 4, 2003, the contents of all of which are incorporated by reference herein

FIELD OF THE INVENTION

This invention relates to the directional control of self-propelled automated pool and tank cleaners that are supported by moving brushes positioned at opposing ends of the cleaner housing.

BACKGROUND OF THE INVENTION

A wide variety of methods and apparatus for controlling the patterns of movement of tank and swimming pool cleaners have been disclosed in the prior art. The overriding purpose of these controls is to assure that the cleaner passes over substantially the entire surface to be cleaned during the time allotted for cleaning. In the case of tanks and above-ground swimming pools, the robotic cleaner generally makes contact only with the bottom surface of the tank or pool. In the case of in-ground swimming pools, the pool cleaner is designed to climb the side walls, typically to the water line, and then reverse the direction of movement to descend the side wall and resume a cleaning path across the bottom surface of the pool. In some wall cleaning units, the pool cleaner actually moves along the wall as part of its predetermined patterned movement so that its descent is along a different path. In many cases, the pattern of movement is random and the pool cleaner must be operated for many hours, and even then with no real assurance that some surfaces will not be missed.

As used herein, the terms "pool" and "pool cleaner" include commercial and industrial tanks, troughs, basins and the like and tank cleaners.

Pool cleaners of the prior art include those that are supported by a pair of endless tracks or belts that are independently driven by a pair of motors or by a single motor, and those that are supported on generally cylindrical cleaning brushes that in turn are driven by a system of sprockets and pulleys. The moving brushes can be made from a ribbed solid polymer web that is formed into a cylindrical supporting surface or, alternatively, from a foamed polymer material that is either smooth or highly textured and resilient.

In order to control the patterned movement of the pool cleaner, it has been the practice in the art to provide a programmed processor used in conjunction with a controller to stop, start and/or reverse the direction of the driving motor or motors. It is also known in the art to control the orientation of the pool cleaner on the surface to be cleaned by interrupting the power to the pump motor and impeller to create a torsional force sufficient to turn the entire pool cleaner body. In other cases, the processor is provided with a complex algorithm which is designed to move the pool cleaner for a predetermined period of time before changing direction or, in other cases, to cause it to move randomly across the surfaces to be cleaned with the expectation that, given sufficient time, the pool cleaner will in fact cover all submerged surfaces to be cleaner. Devices have also been disclosed that include one or more sensors for detecting a side wall or other obstruction for the purpose of generating a signal that is sent to the processor to cause some change in the operating program of the cleaner.

As will be understood by one of ordinary skill in the art, the cost associated with the design and assembly of a pool cleaner having more than one drive motor is significant. When this is combined with the expense associated with the design and fabrication of integrated circuit devices and processors embodying complex programs and algorithms and the associated controllers, it will be apparent that additional substantial expenses will be incurred. Moreover, the mechanical linkages associated with the dual drive motors are sources of wear and potential failure that require maintenance.

It is therefore an object of this invention to provide a relatively simpler and less expensive apparatus and method for controlling the direction of movement of a tank and pool cleaner as compared to those of the prior art that requires only one drive motor.

It is a further object of the invention to provide a pool cleaner directional control apparatus and method that will function in tank and pool cleaners adapted to cleaning only the bottom surface, but that will also ascend the side walls of a pool, while at the same time establishing a regular and regulated pattern of movement that will assure cleaning contact with all surfaces in a relatively short period of time.

A further object of the invention is to provide a directional control system for a pool cleaner that utilizes a relatively simple processor program, including one that can be adjusted for customized for use with a given style and/or size of pool.

SUMMARY OF THE INVENTION

The above objects and further advantages are achieved with the method and apparatus of the invention in which the pool cleaner body is supported on a pair of co-axially mounted, but separate brushes positioned at opposing ends of the pool cleaner housing, one of each of the pair of brushes being driven by a common drive means, e.g., a belt attached to a single drive motor. The driven brushes will alternately assume a leading and trailing position, depending upon the direction of movement of the cleaner. Each of the driven brushes are operably connected to the respective adjacent free brush by a rotational delay clutch mechanism. Both brushes are preferably mounted for axial rotation on a common axle.

The direction of rotation of the drive motor, and thereby the direction of movement of the pool cleaner, is determined by the programmed processor and associated controller. When the direction of the drive motor is changed, the rotational delay clutch disengages the driven brush from the adjacent free brush for a predetermined degree or amount of arcuate movement or rotation by the driven brush. The free brush stops moving for a predetermined number of partial and/or full turns of the driven brush. This has the effect of causing a turning or pivoting movement around the stationary free brushes.

After the predetermined degree of rotational movement by the leading and trailing brushes on one side of the cleaner housing, the clutch engages the adjacent leading and aft free brushes so that both pairs of brushes at either end of the unit are again moving synchronously and the cleaner advances in a straight line.

The method and apparatus of the invention broadly contemplates utilizing the differential angular rotational movement of one-side of a pair of supporting brushes respectively positioned at the fore and aft ends of the pool cleaner to effect a turning or pivotal movement of the pool cleaner and then engaging the respective adjacent free brush, whereby the differential rotational movement is eliminated and the adjacent driven and free brushes rotate at the same angular rate. In one preferred embodiment, the drive and free brushes are mounted on a common axle. However, other mounting arrangements are mechanically possible and within the scope of the invention.

It will be understood that the differential angular rotational movement of the driven and free adjacent brushes can be achieved by entirely interrupting the rotation of the free brush, but that a differential rotational speed can also be effected with a lower rate of rotation of the free brush to achieve substantially the same result, i.e., the turning of the pool cleaner to move in a different angular direction.

As will be understood by one of ordinary skill in the art, the degree of the change in the direction of the pool cleaner path after each leg will be determined by a number of factors. These include the width of the pool cleaner; the diameter/circumference of the contact surfaces of the brushes; the number of full and/or partial revolutions made by the driven brush before the free brush assumes a synchronous speed of rotation; the frictional force effects between the contact surface of the brushes as determined by the pool surface, e.g., glazed the versus textured concrete; and the nature of the brushes, e.g., molded polyvinyl chloride, expanded polymeric foam having a smooth surface and polymeric foam with a resilient textured surface. For example, a pool cleaner having brushes with a three-inch diameter will have a circumference of about nine and one-half inches. A full turn of the fore and aft brushes will theoretically move one end of the pool cleaner a distance somewhat less than nine inches from its starting point. Frictional forces, inertia and the overall movement of the pool cleaner will reduce the actual distance somewhat.

As will be apparent to one of ordinary skill in the art, the configuration of the pool cleaner, including particularly the size of the brushes, and its relative width, as well as the conditions in the pool or tank in which the machine is to be operated must be taken into account in applying the method and apparatus of the invention. The program design and implementation are well within the skill of the art of programmers familiar with the operation and control of robotic tank and pool cleaners of the prior art.

In one preferred embodiment, a first clutch member is secured to the interior end of each of the driven brushes and the opposing surface of the free brush; a projecting pin or other form of engagement member extends from the driven clutch plate towards the opposing interior surface of the second or free plate which is provided with a groove for receiving the projecting pin in rotationally sliding relation. The groove in the free clutch plate also includes a stationary engagement member. When the driven clutch plate is caused to rotate, its projecting pin will rotate in the groove in the free plate until it reaches the projecting engagement member in the free brush clutch plate, after which the two will move synchronously.

When the direction of rotation of the driven brush is reversed, the projecting pin in the driven plate will move approximately one full rotation in the groove until it reaches the engagement member in the free plate. As will be understood from the description of this embodiment, with each change in direction, the free brush remains stationary while the driven brush moves through approximately one full rotation before the clutch members are fully engaged and synchronous rotation is resumed.

In a modification of this embodiment, an intermediate clutch plate that is grooved on one side and includes projecting engagement members on its opposing surfaces is inserted between the driven and the free clutch plate faces. When the direction of rotation of the drive motor is reversed, the projecting pin on the face of the driven clutch plate moves approximately one full rotation before engaging the corresponding pin in the adjacent intermediate plate, thereby causing it to also rotate. The projecting pin on the opposing side of the intermediate plate continues to rotate in a corresponding groove in the adjacent free clutch plate, but without moving the free plate until it reaches the free plate's engagement member. This arrangement provides for almost two complete rotations by the driven brush before the free brush begins to move synchronously.

In a further modification of this embodiment, the opposing sides of the intermediate clutch plate are both provided with a groove and an engagement member. In this embodiment, an additional nearly complete rotation is completed before the free brush clutch plate is engaged and causes the synchronous turning of the free brush to which it is attached.

In a further modification of this embodiment, a plurality of intermediate clutch plates, constructed in accordance with the description of the single grooved intermediate clutch plate or the double grooved intermediate clutch plate of the previous embodiments, are inserted on a common axis of rotation with the opposing clutch plates mounted on the free and driven brushes. As will be understood from the prior descriptions, each intermediate clutch plate can provide one or two almost complete further rotations.

It will also be apparent that the width of the respective projecting pins and of the engagement members will reduce the angular rotation from 360°. The amount of this reduction can be minimized by minimizing the size of the projecting and engagement members, i.e., by using a relatively narrow strip of corrosion-resistant metal, e.g., stainless steel; or by molding or machining the grooves to leave a relatively narrow web of material in each of the opposing faces.

In a further preferred embodiment of a mechanical delay clutch mechanism in accordance with the method and apparatus of the invention, the opposite ends of a length of flexible wire or similar material is attached to the opposing faces of the driven and free brushes. As the driven brush rotates in one direction, the wire is wrapped around the axle on which the brushes are mounted until all slack has been taken up, at which point the free brush begins to rotate synchronously. When the direction of rotation of the drive motor is reversed, the corresponding change in direction of rotation of the driven brush causes slack to form in the wire as it is unwrapped from the axle in the first direction and the free wheel ceases to move. This effect continues until the driven brush has rotated sufficiently to again take up the slack around the axle, at which point the free brush begins to move synchronously with the driven brush.

In this embodiment, the extent of the angular rotation of the driven brush before the free brush begins to move is the subject of several variables, including the length of the wire, the diameter of the axle around which the wire must be wrapped and the relative radial position at which the respective ends of the wire are mounted on the opposing faces of the free and driven brushes.

As used herein, the term wire will be understood to include braided stainless steel wire, braided nylon, nylon monofilament, cording formed of aromatic polyamide fibers, and other man-made and natural fibers and materials that are able to be repeatedly wound and unwound while resisting bending fatigue and/or work hardening and undue stretching under tension.

In another preferred embodiment, a variably expandable member, e.g., a bladder, is positioned between a housing on the driven brush and a corresponding housing on the free brush and a pressurized fluid is gradually added to the expandable member when the direction of rotation of the driven brush is reversed so that there is a predetermined period of differential movement between the free brush and the driven brush. When the drive motor is stopped prior to reversing its direction, the pressurized fluid is discharged from the inflatable member which retracts or deflates from its position of engagement with the housing member attached to, or associated with the free brush. In this embodiment, a pressurized stream of water from the pool can conveniently be introduced into the expandable member, e.g., a polymeric bladder that gradually expands radially and/or axially in the direction of the housing mounted on the opposing end of the free brush. When the motor stops, the bladder is depressurized and the fluid is discharged, thereby disengaging the free brush from the driven brush and causing the cleaner to change its direction of movement.

In a further embodiment, the opposing end faces of the driven and free brushes are provided with an orbital gear system, the size and number of gear teeth on the respective central and orbital gear members being predetermined to provide disengagement of the free brush in order to effect the desired degree of turning of the pool cleaner.

An electro-magnetic clutch can also be utilized with the activation of the engagement of the clutch plates is programmed into the processor. In the embodiment utilizing an electro-magnetic mechanism, the driven brushes operate independently of the free brushes for a predetermined amount of time to complete the turning of the body and then the electro-magnetic clutch is powered to cause the free brushes to move synchronously with the driven brushes. The program controller disengages the electro-magnetic clutch at the same time that the drive motor stops; thereafter a timer in the controller is initiated when the drive motor is started in the opposite direction and the process steps are repeated.

In a related embodiment, the electro-mechanical clutch is spring-biased toward engagement to produce synchronous movement of the driven and free brushes; disengagement is intermittent for the purpose of effecting a change in direction. The method of operation is preferred when a battery provides the power.

As will be apparent to one of ordinary skill in the art, other methods and apparatus can be utilized to effect the differential movement between the driven and free brushes based upon a timed interval or predetermined amount of angular rotation in order to effect the desired change in direction of the pool cleaner following stopping and reversing of the drive motor. For example, a solenoid can be activated to urge an axially displaceable clutch plate on either of the driven or free brushes into or out of mating engagement with the opposing clutch plate. Any of a number of other electro-mechanical constructions can be utilized in order to achieve the desired result.

It is to be understood that the pump motor which provides a force vector in the direction of the surface on which the pool cleaner is moving runs continuously throughout the operation of the pool cleaner in accordance with the method of the invention. This downward thrust maintains the pool cleaner traction means in contact with the surface at all times. This is an improvement over prior art methods in which the pump motor is stopped or its rotational speed greatly decreased to reduce the frictional forces between the brushes and the pool surface during turning maneuvers. In accordance with the present invention, by stopping the movement of brushes on one side of the cleaner while rotating the respective adjacent brushes on the opposite side of the cleaner, provides sufficient traction to cause the unit to turn into the new desired direction of travel before synchronizing the movement of the respective adjacent brushes, without reducing the downward force vector that serves to maintain the nearly neutrally bouyant pool cleaner on the horizontal or vertical surface over which it is moving.

Directional Control Program

In a further aspect, the invention also contemplates a novel program and system for controlling the movement of the pool cleaner in a highly efficient repetitive pattern that will cause the pool cleaner to pass over substantially the entire surface of the pool or tank that is to be cleaned, regardless of it's external configuration, e.g., rectilinear, curvilinear or a combination of the two. The directional control program is adapted to cleaning only the bottom surface of a pool or tank, as well as efficiently controlling the movement of a pool cleaner in the cleaning of both the bottom and the side walls of the pool.

In one preferred embodiment, the programmed directional movement of the pool cleaner is along a first longer leg for a predetermined period of time; the drive motor stops and the direction is reversed; the driven brushes at either end of one side of the pool cleaner turn at a greater rotational velocity than the free brushes for a predetermined number of revolutions to thereby cause the cleaner body to turn; the free brushes are then engaged for synchronous movement with the respective adjacent driven brushes and the pool cleaner advances along a second leg for a shorter period of time at the end of which the drive motor stops and reverses direction; the above steps are repeated for a predetermined number of cycles after which the power to the drive motor continues uninterrupted for a time that is approximately twice the time allotted for the longer leg; after the extended running time, the drive motor is stopped and its direction reversed; the original steps are repeated for the same predetermined number of cycles as above.

In programming the processor, the times allotted for the pool cleaner to traverse the relatively longer and shorter legs is determined with reference to the speed of the motor, the diameter/circumference of the brushes and the size of the pool or tank in which the cleaner is to operate. For example, a high speed drive motor can produce a speed of about 60 feet per minute in a belt-driven pool cleaner while a conventional (lower) speed motor will produce a cleaner speed of about 30 feet per minute across the bottom surface of the pool.

In one preferred embodiment, the shorter leg of travel is sufficient to cause the pool cleaner to traverse a distance that exceeds half of the bottom width of the pool. In the case of a pool cleaner equipped with a conventional, or low speed motor, the length of time allotted for a complete cycle is one minute with the longer leg being allotted 36 seconds and the shorter leg 24 seconds. In this embodiment, after thirty such cycles, the order of long and short legs is reversed. In this mode of operation the pool cleaner moves from one side of the pool via a zig-zag path until it reaches the other side of the pool. When this occurs, the relative direction of the cleaning pattern will be reversed, i.e., if the pool cleaner was moving in a counter-clockwise direction around the periphery of the pool for the previous thirty cycles, after the cleaner has crossed the pool and reaches the opposite water line, the next thirty cycles will be in a clockwise direction with respect to the periphery of the pool.

In this mode of operation, it has been found that a pool cleaner employing the method and apparatus of the invention, equipped with a high speed motor and a resultant angular change in direction of about 15° to 60°, when operated in a large, residential swimming pool of a irregular curvilinear configuration traversed the perimeter approximately 3½ times in one hour.

Optional Battery Operation

In accordance with the invention, the highly efficient mode of operation of the pool cleaner with a single drive motor in combination with a highly efficient cleaning pattern, enables the unit to be powered by an on-board rechargeable battery. A further advantage of the apparatus and method of the invention is that it obviates the need to have the pool cleaner move horizontally along the waterline of the pool in order to assume a new direction of movement once the drive motor is reversed.

The elimination of the floating power cable from an external power source renders the pool cleaner even more efficient and eliminates any possibility that the program will be interrupted by the forces applied to the nearly neutral buoyant pool cleaner. Battery-powered operation also eliminates the risk that the power cable will interfere with the movement of the brushes when the unit is operating at the waterline.

Use of Mercury Switch

In yet a further preferred embodiment of the invention, the processor and controller circuit includes a mercury switch that is activated when the pool cleaner body moves from a generally horizontal position to an angle of about 70° or more at either end. The signal initiates a timed-operational period after which the drive motor is stopped and reversed. Thus, as the pool cleaner approaches a side wall and moves from a generally horizontal to a generally vertical orientation, the movement of the mercury switch completes a circuit that produces a signal received by the processor that activates a time clock circuit. After a predetermined period of time, which can be, e.g., eight seconds to twenty seconds, the drive motor is stopped and its direction reversed. The predetermined time interval following receipt of the signal from the mercury switch can be sufficient to insure that the pool cleaner will reach the water line of the pool before the motor reverses direction.

In this embodiment, the shorter leg of travel is preferably sufficient to cause the pool cleaner to traverse approximately one-half of the width of the pool during each cycle; the longer leg of travel need not be predetermined in the operating program, since the pool cleaner will eventually generate a signal via the mercury switch as the unit begins its ascent of a wall.

As in the prior preferred embodiment, the processor can preferably be programmed to operate in a cyclic mode with a periodic change in direction of movement from counter-clockwise to clockwise and vice versa.

In the embodiment in which two motors are employed to drive each of the co-axially mounted, but independent pair of brushes, the program of the processor can include the step of reversing the direction of rotation after a predetermined number of cycles. This will allow the pool cleaner to change from a clockwise pattern of movement with respect to the periphery of the swimming pool to a counter-clockwise pattern without the requirement that the pool cleaner completely traverse the bottom and, if appropriate, opposite side wall of the pool as was described in the single drive motor embodiments described above.

When the pool cleaner reaches the waterline, the longitudinal axis of the pool cleaner will generally become oriented in a direction that is normal to the waterline before the timed stopping and reversal of the drive motor. In this configuration, the unit makes the angular turn to change direction when the drive motor causes the rotation of one of each pair of the fore and aft brushes that are positioned on the same side of the cleaner housing. In the event that the pool cleaner has approached the waterline at a relatively small acute angle and the timed operation from the generation of the mercury switch signal is insufficient to permit the unit to assume a generally vertical position on the side wall, the pool cleaner will, nevertheless return to the bottom along a different path from the waterline. Moreover, a pool cleaner constructed and operating in accordance with the improved programmed control method of the invention will not be adversely effected with respect to its ability to cover the surfaces to be cleaned during the time allotted for completing the cleaning of the pool.

Two Drive Motor Alternative Embodiment

Although the preferred embodiments of the invention as described above operate most efficiently with a single drive motor with a delayed starting of one of a pair of co-axial adjacent brushes using mechanical means to effect the delay that is followed by synchronous rotation of the brushes, this highly efficient cleaning pattern can also be accomplished utilizing a second drive motor. In the embodiment utilizing two drive motors, no clutch or other delayed linking mechanism is required. Each one of the pair of fore and aft brushes turns separately in response to the action of the independent drive motors. The processor is programmed to operate one of the drive motors in the manner that was described above in the embodiments with a free brush. The predetermined delay in starting the rotation of the adjacent brush is entered into the processor program so that the same end result is achieved in terms of patterned movement, but without the mechanical linkage between the adjacent brushes at either end of the pool cleaner body.

As will be apparent to one of ordinary skill in the art, the use of a second drive motor increases the cost of materials and labor in assembling the pool cleaner, adds to its weight, as well as increasing the operating and maintenance expense. The addition of the second drive motor may also render it impractical to utilize a self-contained battery mounted in the pool cleaner body, since the power drain will be substantially increased.

BRIEF DESCRIPTION OF THE DRAWINGS

The invention will be described in further detail below and with reference to the attached drawings in which:

FIG. 6 is a perspective view of a further embodiment of a rotational clutch assembly;

FIG. 7 is a cross-sectional view of the clutch assembly of FIG. 6 at line 7-7;

Referring now to FIG. 1, there is shown a pool cleaner 100 having a housing 102 with an outlet 104 in the upper portion of the housing for the discharge of water from the filter pump in order to urge the cleaner brushes into contact with the surfaces to be traversed. Handle 101 is provided near the top of the housing 102 for lifting and carrying the cleaner. At each end of the housing, a pair of brushes 12, 14 are co-axially mounted for rotation. A single drive motor 110 is shaft-mounted to drive pulley 112 that engages drive belt 114.

Figure 1:
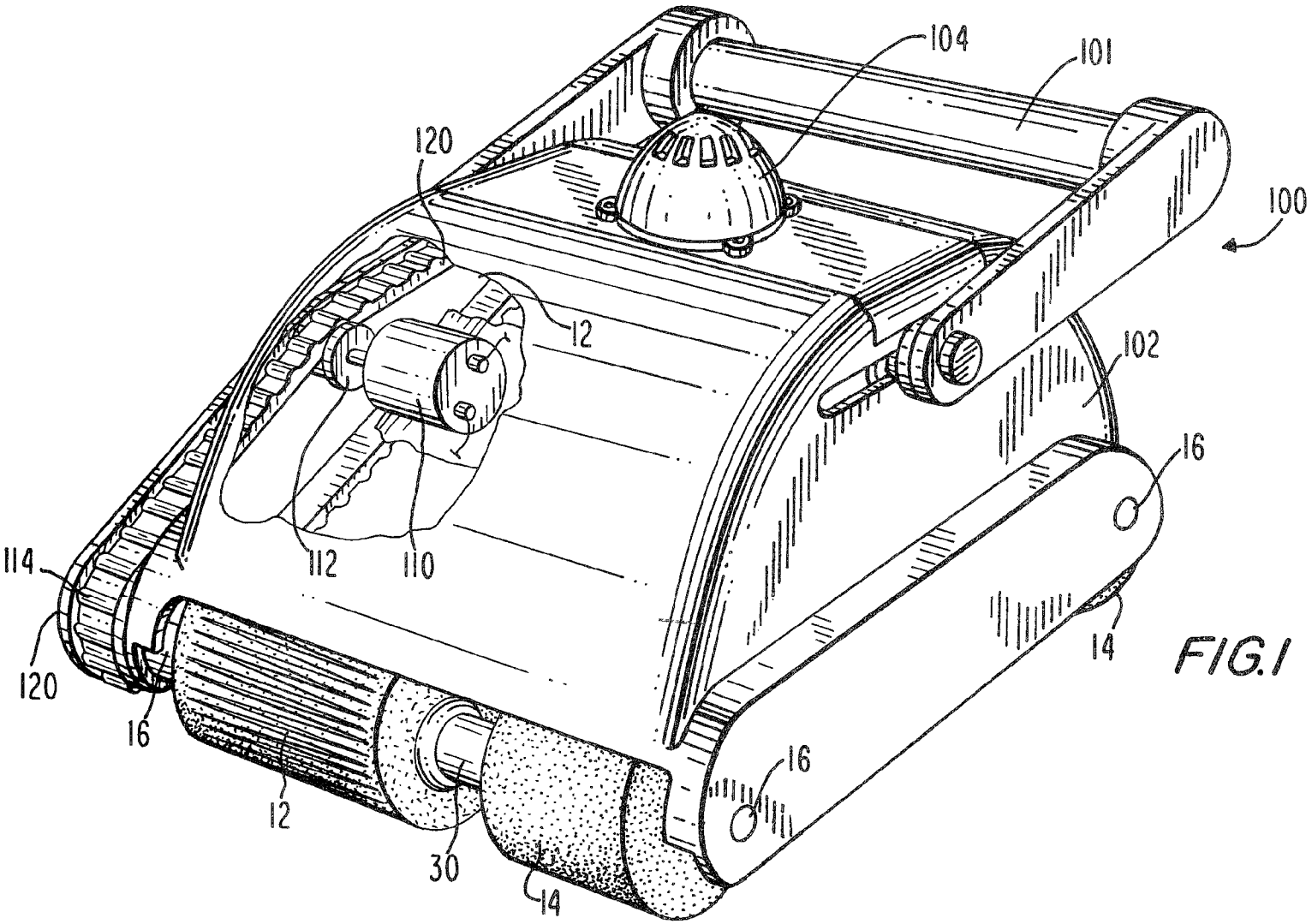
FIG. 1 is a top side perspective view with the housing partly cut away of a pool cleaner illustrating one embodiment of the invention.

The outboard end of brush 12 is fitted with a drive pulley 120 on which drive belt 114 is positioned. Henceforth, brush 12 will be referred to as a "driven brush".

The adjacent brush 14 is mounted on common axle 16, is separate from driven brush 12 and is freely rotatable, within limits that will be described in more detail below. Henceforth, brush 14 will be referred to as a "free brush" in describing the apparatus and method of the invention.

To further facilitate the description and understanding of the invention, driven brush 12 is shown shaded in the figures to differentiate it from free brush 14.

With continuing reference to the embodiment illustrated in FIG. 1, a delay clutch means 30 is positioned between brushes 12 and 14 and co-axially mounted on axle 16.

Figure 2:
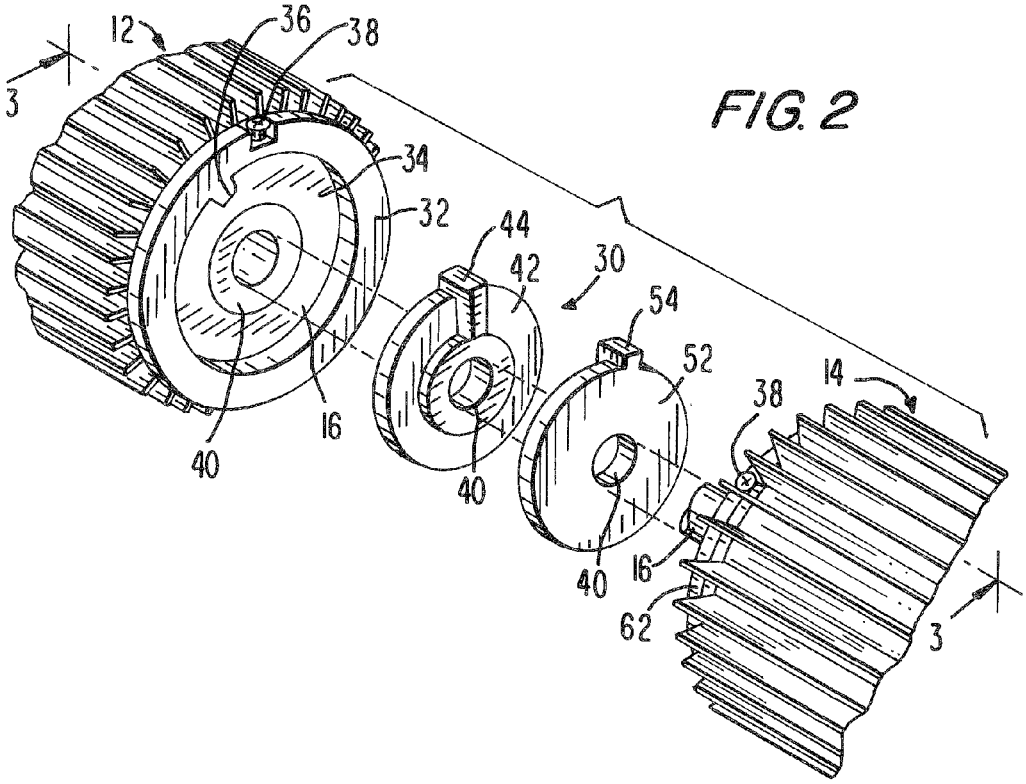
FIG. 2 is an exploded view of one embodiment of a rotational delay clutch mechanism for use in the invention.

Referring now to FIG. 2, driven clutch plate 32 with axial opening 40 is securely mounted to the interior or in-board end of driven brush 12. In the embodiment illustrated, the driven clutch plate 32 has an annular recess 34 into which projects engagement member 36. A set screw 38 is also provided for further adjustment as will be explained below. Opposing clutch plate 62 is securely affixed to the inboard end of free brush 14 and its interior face is configured similarly to plate 32.

Figure 3:
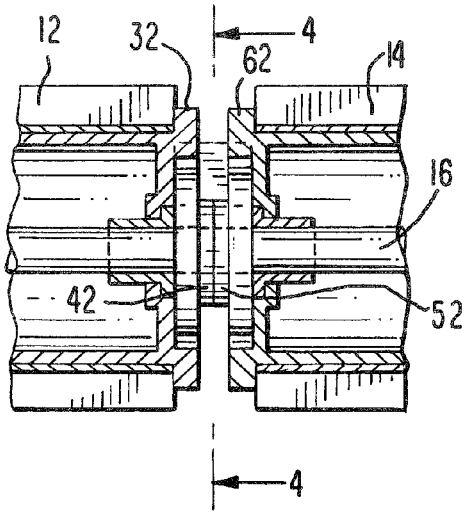
FIG. 3 is a cross-sectional view of the clutch assembly of FIG. 2 at line 3-3.

As further illustrated in this embodiment, a pair of intermediate clutch members 42 and 52 having projecting engagement members 44 and 54, respectively, are mounted between plates 32 and 62. When the driven clutch plate 32 has proceeded through a sufficient number of revolutions, the projecting members 36, and the engagement members 44, 54 are all in contact and the free brush moves synchronously. Upon reversal of the drive motor and driven brush 12, the free brush 14 remains motionless until the intermediate clutch members have rotated sufficiently to bring the engagement members back into contact with the projecting members. In this embodiment, the driven wheel will turn almost three complete revolutions before the free brush begins to move synchronously Referring now to FIG. 3, there is shown a cross-sectional view depicting the mating arrangement of the fixed clutch plates and rotating intermediate clutch members 42 and 52. As clearly shown, all of the elements are mounted for rotation on axle 16.

Figure 4:
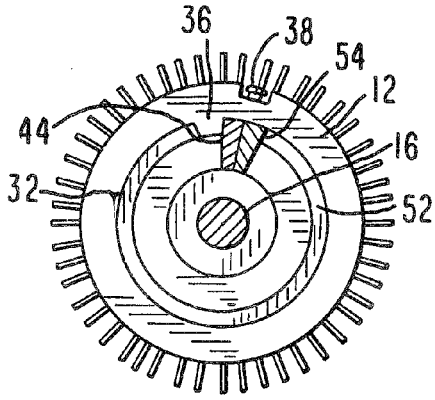
FIG. 4 is a cross-sectional view of the embodiment of FIG. 3 at line 4-4.

The cross-sectional view of FIG. 4 shows the relationship of the projecting member 36 on clutch plate 32 in contact with engagement members 44 and 54. It can also be seen from this cross-sectional view that set screw 38 in the periphery of plate 32 can be lowered to secure intermediate clutch member 42 in position against projecting member 36.

Figure 5:
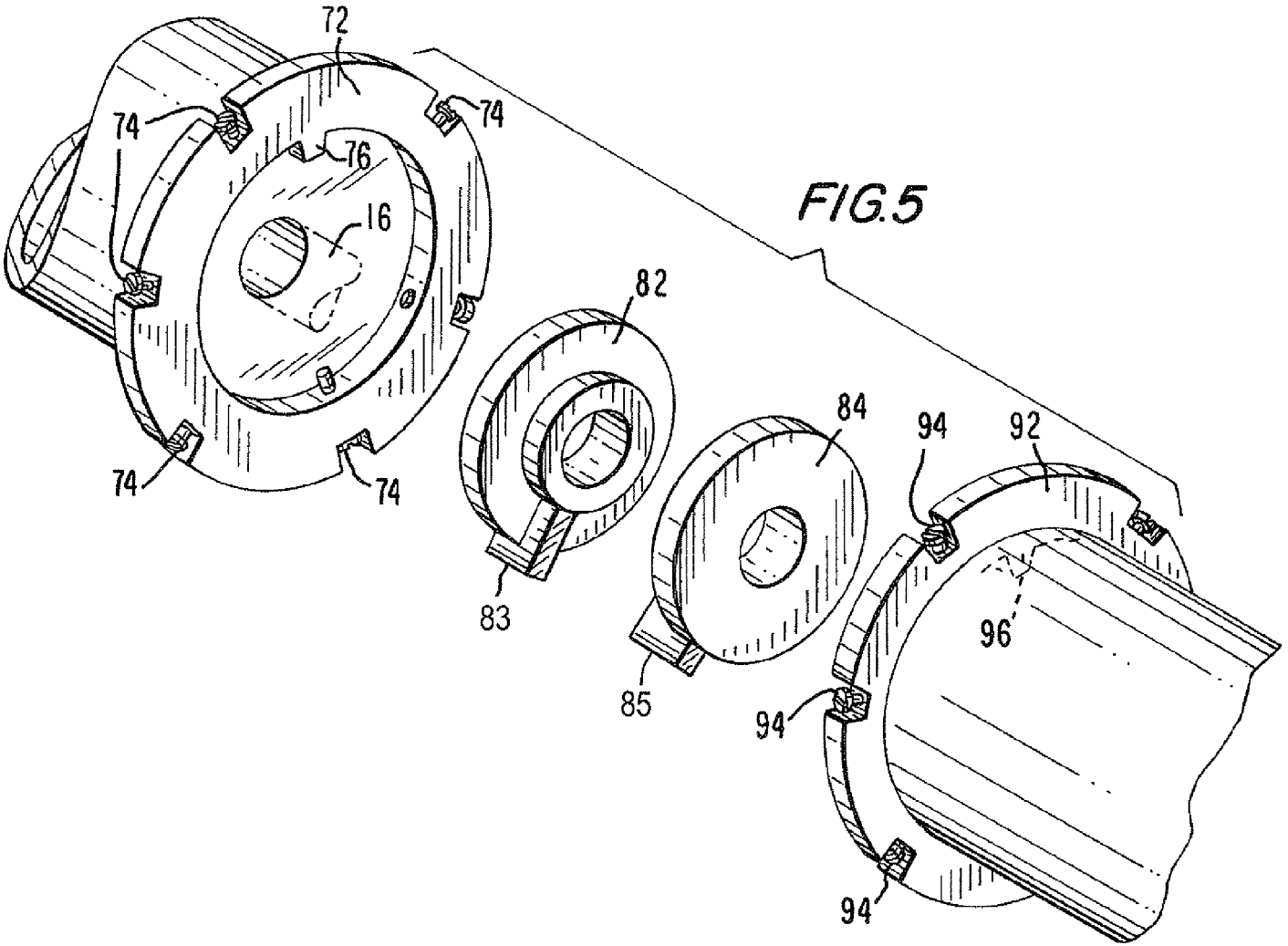
FIG. 5 is an exploded perspective view of another embodiment of a rotational delay clutch assembly.
Figure 8:
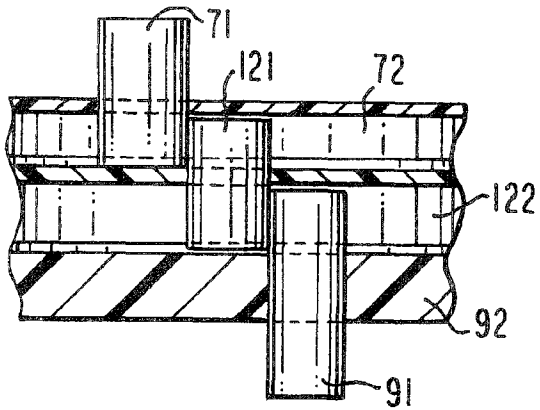
FIG. 8 is a partial sectional view of a portion of the assembly shown in FIG. 6 at lines 8-8.
Figure 9:
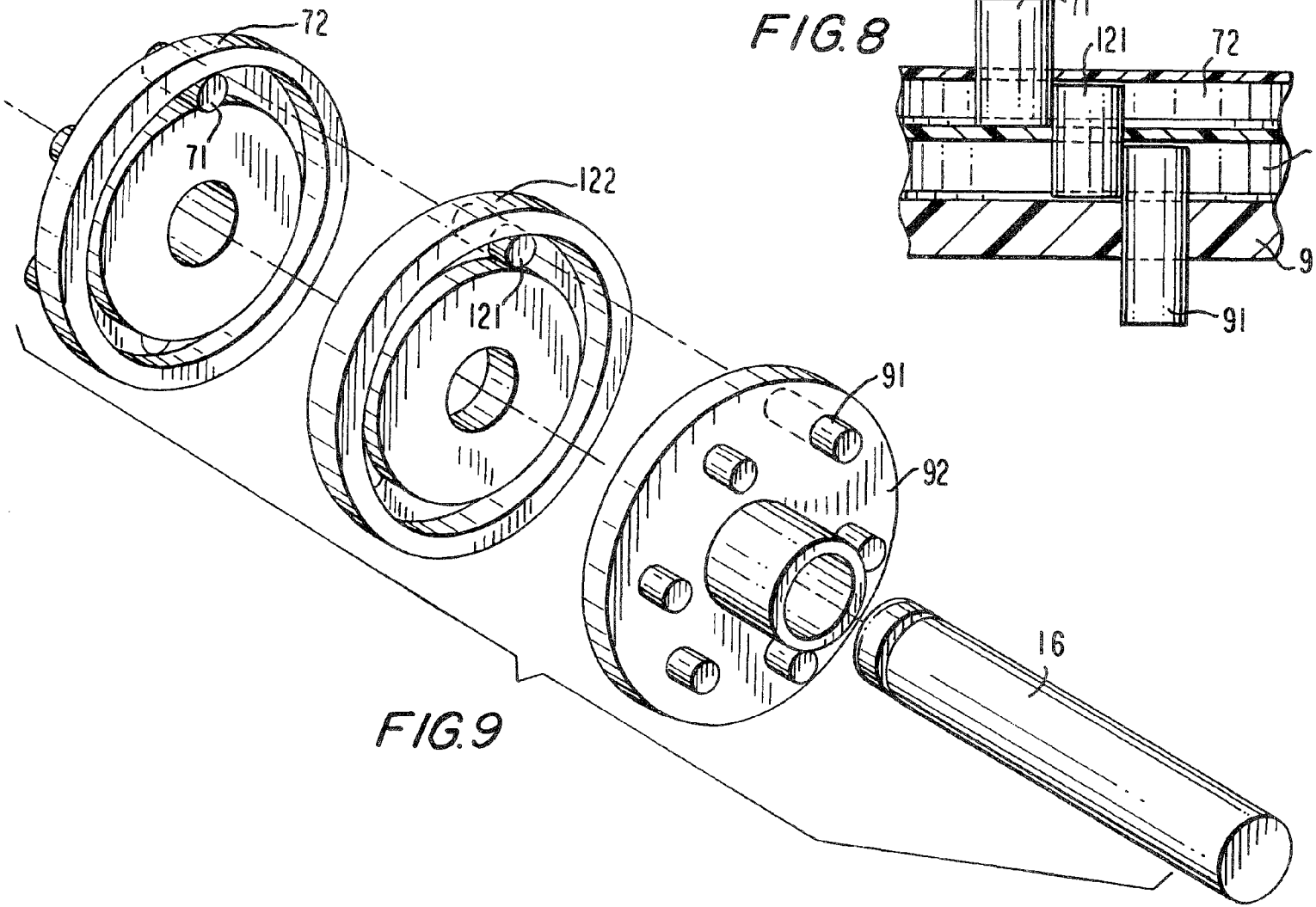
FIG. 9 is an exploded perspective view of the clutch assembly of FIG. 6.

An alternative preferred embodiment of an adjustable delayed drive clutch plate assembly is schematically illustrated in the exploded view of FIG. 5. In the embodiment illustrated, the opposing clutch plates 72 and 92 are provided with a plurality of moveable adjustable projecting members 74 and 94, respectively. The intermediate clutch members 82 and 84 are provided with engagement members 83 and 85, respectively, that are positioned to engage radially projecting contact members 76 and 96. As in the embodiment described above, the clutch assembly is co-axially mounted on axle 16 which is also supporting brushes 12 and 14.

This embodiment of the delay drive clutch assembly permits adjustment to be made to the number of independent rotations by the driven brush before engagement and synchronous operation of the free brush simply by moving one or more of the projecting members 74, 94 on either or both of the end clutch plates 72, 92 radially inward into the central space to contact the engagement members 83 and/or 85 in less than a full revolution. As previously explained, this type of adjustability can be utilized to specifically adapt the number of degrees, or arc that the pool cleaner turns when the drive motor reverses direction.

As will be understood by one of ordinary skill in the art, other structures and configurations can be employed to adjust the number of rotations, or partial rotations. For example, sliding engagement pins (not shown) can be mounted in one or both or the end clutch plates 72, 92 for movement in the axial direction to contact fixed engagement members 83, 85.

A further embodiment is illustrated in FIGS. 6 through 9 where like elements are referred to by numerals as previously described. An intermediate plate 122 is also mounted on axle 16 between end drive plate 72 and end driven plate 92. In this construction, the end plates are provided with a plurality of pins 71 and 91, respectively, and intermediate plate 122 is provided with at least one pin 121 that extends through the plate to be engaged by pins 71 and 91. As will be understood from the description of the functioning of the set screws 74 and 94 of FIG. 5, advancing the pins toward plate 122 advancing the pins toward plate 122 controls the rotational movement between the driving and driven plates 72 and 92 respectively. The number and placement of pins 71 and 91 and their passages through the plates is determined with reference to the variables previously described and the desired degrees of the directional changes to be made by the pool cleaner. The embodiment of FIGS. 6-9 thus allows the user of the pool cleaner to adjust position of the pins to adapt the movement to the requirements of the pool to be cleaned.

Figure 10:
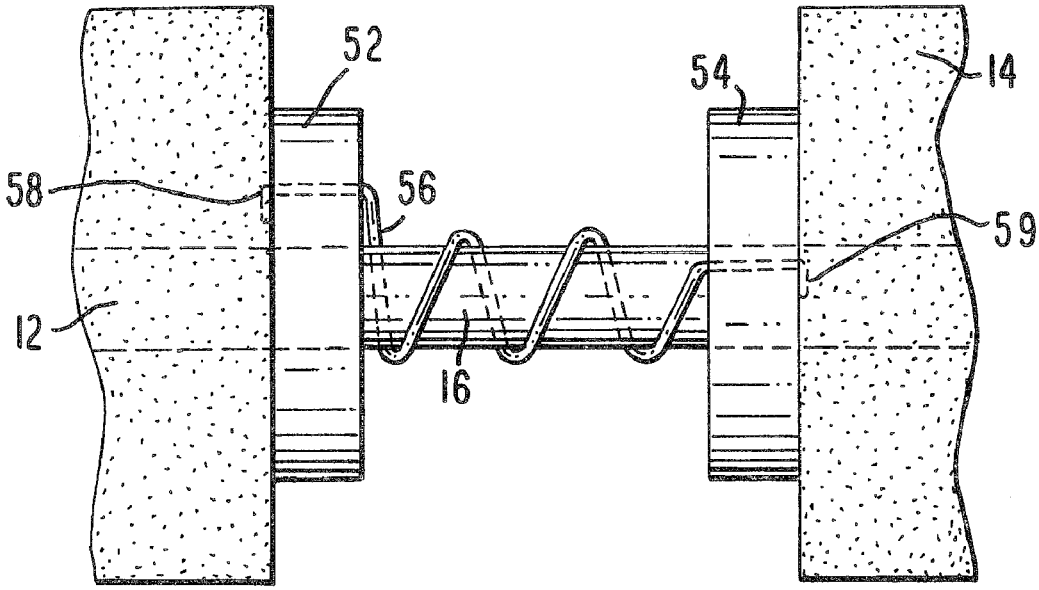
FIG. 10 is a top view, partly in section, of another embodiment of a rotational delay clutch assembly for use with the invention.

Referring to FIG. 10, there is schematically illustrated a delayed drive mechanism employing a flexible wire 56 extending between plates 52 and 54 that are attached respectively to driven brush assembly 12 and free brush assembly 14. In accordance with this embodiment, movement of the driven brush 12 and associated plate 52 will result in wire 56 being spirally wound around axle 16 on which free brush assembly 14 is supported for free rotation after the driven brush 12 has completed a sufficient angular movement.

Figure 11:
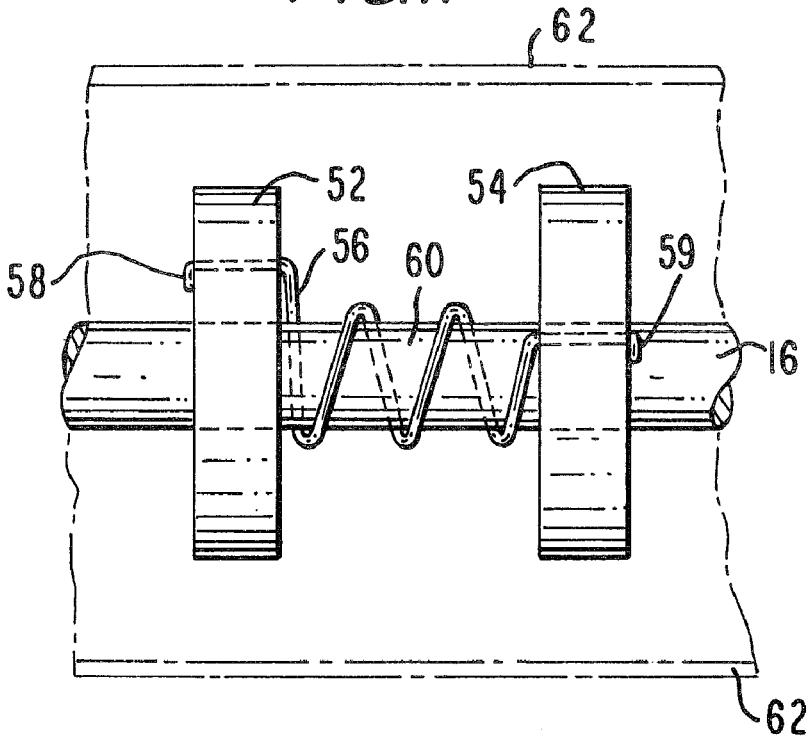
FIG. 11 is a view of a modified embodiment similar to that of FIG. 11.

As shown in FIG. 11, the axle 16 can be provided with a housing 60 of a larger diameter that will require fewer wraps of wire 56 in order to remove all slack and cause free brush 14 to move synchronously with brush 12. The change in the location of the points of attachment 58 and 59 of the opposing ends of wire 56 will also serve to change the number of revolutions or angular displacement experienced by the plate 54 and associated free brush when the slack in the wire is being taken up. It will also be understood that the number of turns required to unwrap the wire from either axle 16 or spool 60 of FIG. 11 will be one-half of the total number of revolutions required before free brush 14 begins to move synchronously with driven brush 12.

It will also be understood from the schematic illustrations of FIGS. 10, and 11 that the plates 52, 54 can be positioned relatively much closer together and that they can be assembled in a protective housing 62, shown in phantom. Alternatively, the plates 52 and 54 can be provided with an annular opening or with a rim so that they are mounted in very close proximity to enclose the wire. Reversing the direction of the drive motor causes the wire to unwind and then wind around the spool or axle 60, thereby turning the pool cleaner at each occasion that the direction is reversed.

Figure 12:
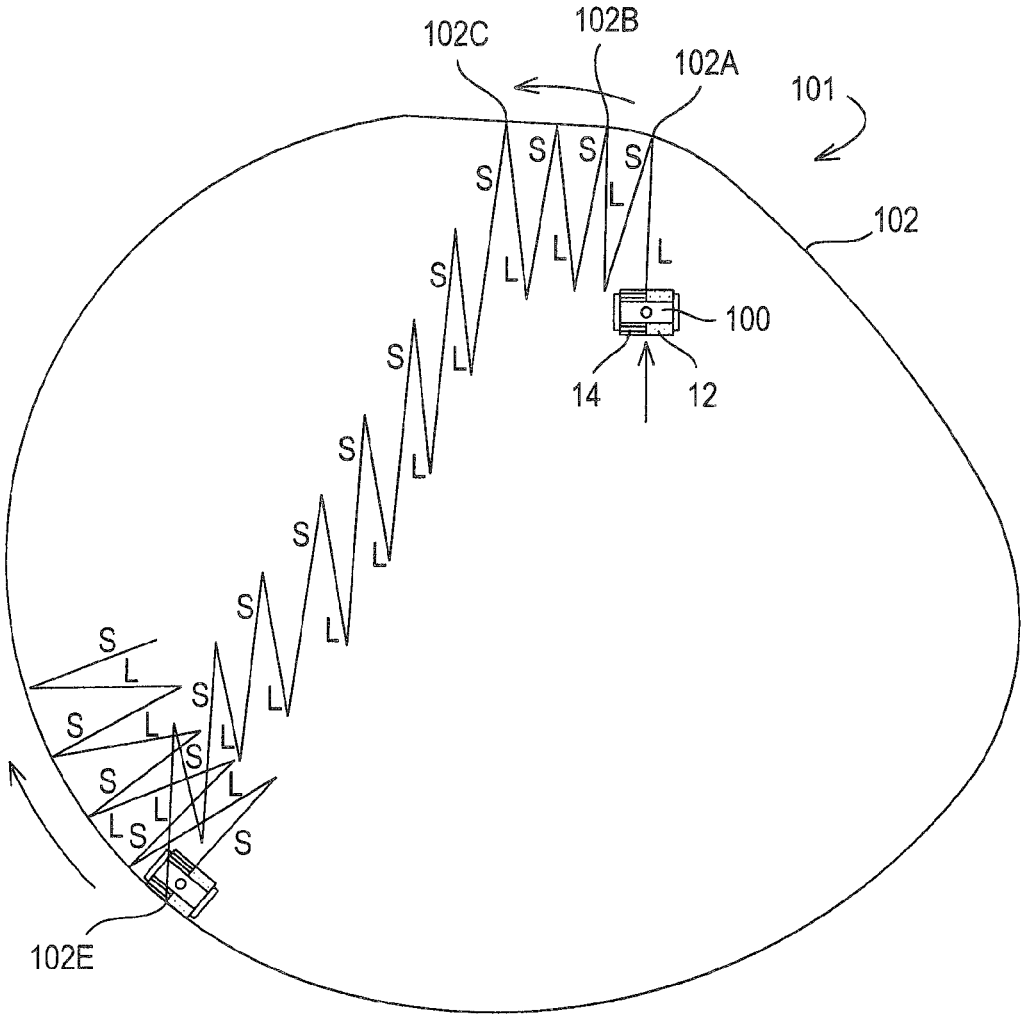
FIG. 12 is a schematic illustration of the movement of a pool cleaner in generally round pool in accordance with method of the invention.

Referring now to FIG. 12, there is schematically illustrated a controlled pattern of movement of a pool cleaner 100 operating in a large, generally circular tank or pool 101, having a perimeter 102. The pool cleaner 100 has fore and aft driven brushes 12 and co-axially mounted free brushes 14. In the mode of operation illustrated, the pool cleaner 100 approaches and contacts the side wall at a first position 102A; the direction of rotation of the drive motor and thereby, driven brushes are reversed and operate for a number of rotations sufficiently to turn the cleaner at an angle in the range of from 15° to 60° and then with synchronous operation of the free brushes 14, to move along a shorter leg (S), after which the unit stops and reverses direction to move along a longer leg (L) to the second position 102B at the periphery of the pool 100.

This pattern of movement continues along alternating long and short legs (L,S) until the predetermined number of cycles have been completed at contact point 102C. Thereafter, the order of the movement along the long and short legs is reversed which causes the cleaner 10 to move in towards the center of the pool 100 so that the pool cleaner does not return to contact the side wall from which it departed. As will be seen from the schematic illustration of FIG. 12, the pool cleaner continues in accordance with the programmed directional control until it reaches a position 102E on the opposite side wall. As the program is reversed, the pattern of movement of the pool cleaner 100 with respect to the periphery 102 of pool 101 changes from counter-clockwise to clockwise.

Figure 13A:
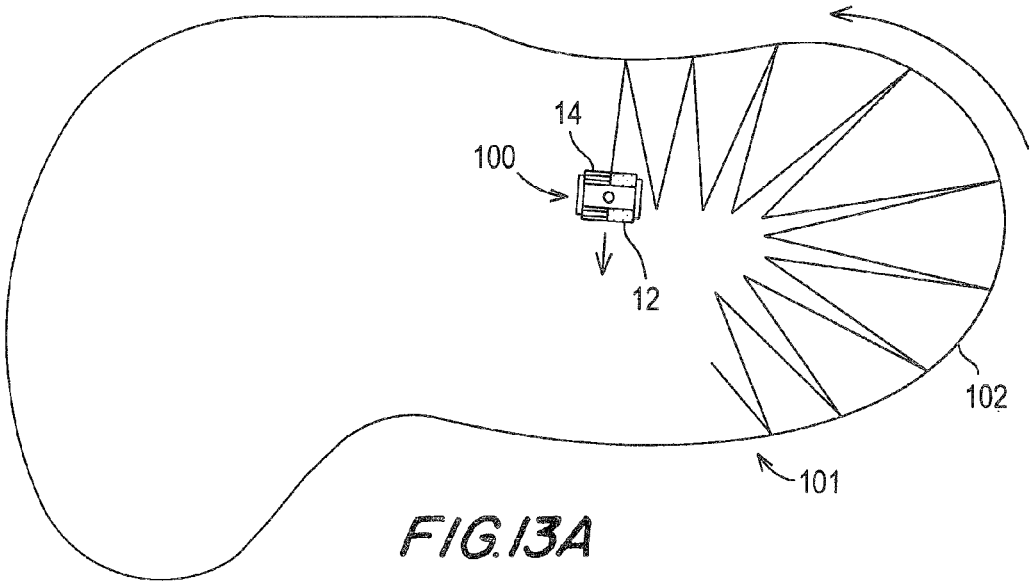
FIGS. 13A and 13B are schematic illustrations of the movement of a pool cleaner in an irregular shaped pool in accordance with one method of the invention.
Figure 13B:
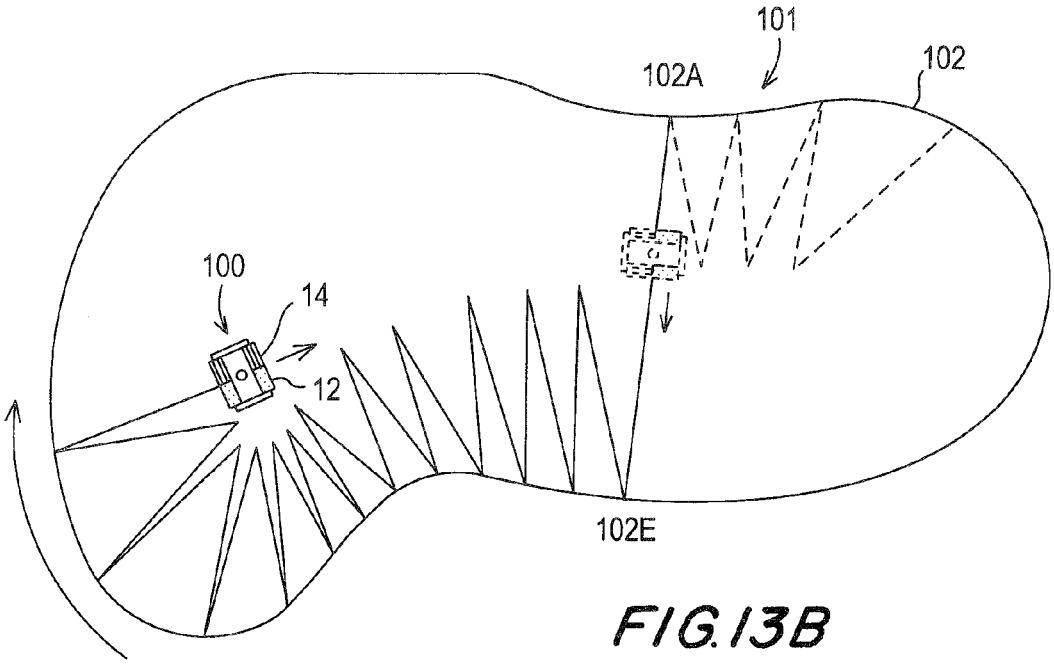

Referring now to FIG. 13, there is schematically illustrated the controlled directional movement of a pool cleaner 100 in accordance with one preferred method of operation of the invention. The pool cleaner 100 initially moves up to and away from the side wall of the irregularly shaped pool 101 for a pre-determined number of cycles. In accordance with the illustration of FIG. 13, at the end of the first number of cycles at point 102A on the side of the pool, an extra long leg L' permits the pool cleaner to cross the entire bottom surface of the pool and ascend the opposite wall at 102E. Thereafter, the pool cleaner resumes its programmed cleaning operation to run the predetermined long and short legs, but during this cycle moving in a clockwise direction.

Figure 14A:
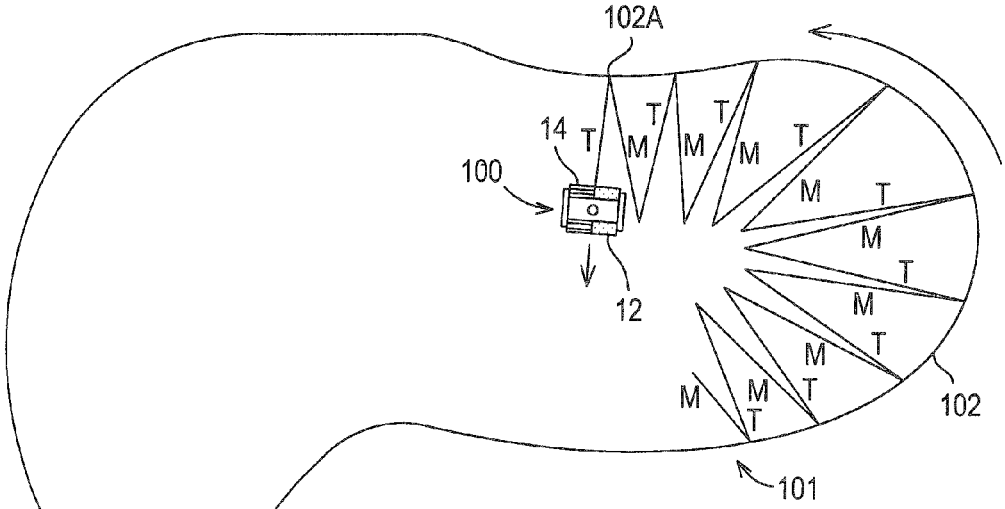
FIGS. 14A and 14B are schematic illustrations similar to FIGS. 13A and 13B of a further embodiment of the method of the invention.
Figure 14B:
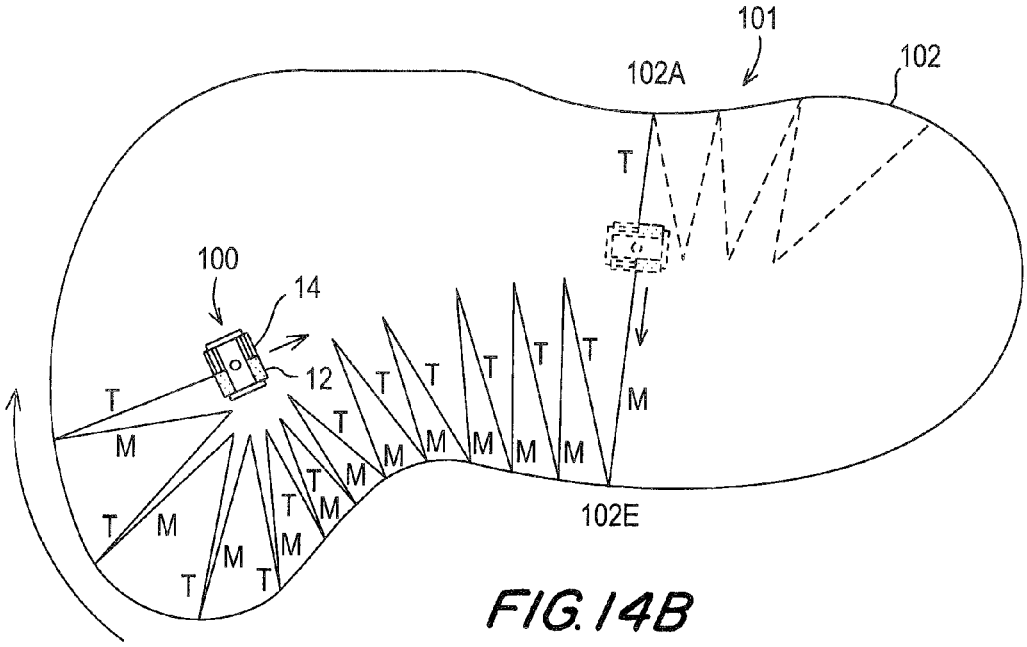

A further mode of operation will be described with reference to FIGS. 14A and 14B where there is schematically illustrated controlled directional movement of pool cleaner 100 that is equipped with a mercury switch that generates a signal when the orientation of the pool cleaner body moves from horizontal to a pre-determined angle of about 70°. As the pool cleaner 100 moves up on the wall the mercury switch signal is received by the processor and a time clock provides a delay of, e.g., eight seconds before the drive motor is stopped and reversed. The processor timer then allows the pool cleaner to go past the middle of the pool before it reverses the direction of the drive motor. Thus, the pool cleaner is running on a program which is based on alternating mercury switch and time control. The long leg (M) is controlled by a mercury switch, while the short leg (T) is controlled by a timer.

This cycle is repeated a predetermined number of times after which as the pool cleaner descends the wall and goes past the middle of the pool, it does not reverse when time control changes to mercury switch control, but continues to move across the pool and resumes its program, but moving in a clockwise direction.

From the above description, it will be seen that the method and apparatus of the invention of controlling the movement of the pool cleaner is accomplished without resorting to a complicated algorithm embedded in the processor that must be executed by the controller. The relative simplicity of the means for controlling the movement of the cleaner permits the apparatus to be adjusted for the particular conditions of the tank of pool to be cleaned.

We claim:

1. A method of controlling the directional movement of a self-propelled robotic pool cleaner comprising the steps of:
   a. providing a pool cleaner having a first and second pair of dual brushes co-axially mounted at opposite ends of the pool cleaner for rotation on axles that are transverse to the direction of movement, the first pair of brushes being mounted on one side and the second pair of brushes mounted on the opposite side of the cleaner, the pool cleaner being propelled by the synchronous rotation of the first and second pairs of brushes, said pool cleaner having at least one drive motor operatively connected to the first pair of brushes for synchronous drive;
   b. activating the at least one drive motor to propel the pool cleaner in a first direction along a substantially straight path by the synchronous rotation of the first and second pair of brushes;
   c. stopping and reversing the drive motor to disengage the second pair of brushes to thereby rotate the first pair of brushes at a greater angular rotational velocity than the second pair of brushes thereby pivoting the pool cleaner through a predetermined angular change in direction; and
   d. engaging the second pair of brushes to thereby resume the synchronous rotation of the second pair of dual brushes with the first pair of brushes, whereby the pool cleaner moves in a second direction along a substantially straight path that is angularly displaced from the first direction.

2. The method of claim 1, wherein the pool cleaner is provided with a rotational delay clutch co-axially positioned between each of the first and second pair of dual brushes at either end of the pool cleaner,
   and the method of step (d) includes rotating the first pair of driven brushes through a predetermined number of degrees of angular rotation while the second pair of free brushes remain stationary; and
   engaging the second pair of brushes via the clutch to initiate synchronous rotation of the second pair with first pair of brushes.

3. The method of claim 2, wherein the rotational delay clutch includes a fixed clutch plate attached to each of the opposing faces of the first and second pair of brushes, and the method includes rotating the first fixed plate until it engages the opposing plate on the second pair of brushes to initiate the synchronous rotation of the second pair of brushes with the first pair of brushes.

4. The method of claim 2, wherein the rotational delay clutch includes a fixed clutch plate attached to opposing faces of each of the first and second pair of brushes and at least one intermediate free plate that is mounted for rotation on the axle between the fixed clutch plates, and the method includes rotating the first fixed plate to engage the at least one intermediate free plate and continuing said rotation to engage the opposing fixed plate on the free second brush to initiate the synchronous rotation of the second pair of brushes with the first pair of brushes.

5. The method of claim 2, wherein the rotational delay clutch includes an elongated flexible member extending between opposing end members attached to each of the opposing faces of the first and second brushes on each axle and in winding contact with the axle, and the method includes rotating the first pair of brushes to first unwind the flexible member and then to rewind the flexible member in the opposite direction until synchronous rotation of the second pair of free brushes is initiated.

6. The method of claim 2, wherein the rotational delay clutch includes an expandable member rotatably positioned between the opposing ends of each of the first and second brushes, and the method includes applying a pressurized fluid to extend the expandable member to frictionally engage the second brush while the first brush is rotating and thereby initiate synchronous rotation of the second pair of brushes with the first pair of brushes.

7. The method of claim 2, wherein the rotational delay clutch includes a two-part orbital gear assembly, a first rotating member of which gear is attached to each of the first brushes and a second member of which is attached to each of the second brushes, whereby the first and second orbital gear members are temporarily disengaged when the direction for rotation of the first brush is reversed and are engaged after a predetermined rotation of the first brushes.

8. The method of claim 2, wherein the rotational delay clutch includes an electromechanical clutch engagement assembly and associated means for actuating the engagement of the first and second brushes at predetermined intervals following a reversal of direction of rotation of the first pair of brushes.

9. The method of claim 1, wherein the pool cleaner is provided with a first drive motor operatively connected to the first pair of brushes, a second drive motor operatively connected to the second pair of brushes, a controller for controlling the operational speed and direction of the respective motors in response to a processor signal, and the method further comprises the steps of:

e. actuating the first and second drive motors simultaneously to propel the pool cleaner in the first direction;

f. stopping the first and second drive motors and actuating the first motor for rotation in the opposite direction at a rotational velocity that is greater than that of the second motor; and g. after a predetermined period of time, actuating the second drive motor for synchronous rotation with the first drive motor.

10. The method of claim 9, wherein the second motor remains stopped during step (f).

11. The method of claim 1 which further comprises:

operating the pool cleaner in accordance with a program in which it is propelled in the first direction for a first predetermined period of time and in the angularly displaced second direction for a second predetermined period of time that is less than the first period of time, and repeating this pattern of programmed movement.

12. The method of claim 11, wherein the pool cleaner traverses about one-half of the distance between the side walls of the pool during the second period of time.

13. The method of claim 11, wherein the pattern of programmed movement is repeated for a predetermined number of cycles constituting an original cycle, after which the pool cleaner is propelled in the first direction for an extended period of time that is about twice the first period of time, after which the pool cleaner is stopped and the original cycle is then repeated.

14. The method of claim 12, wherein the pool cleaner changes from a clockwise to a counter-clockwise pattern of movement during the cycle of time in which it is cleaning the pool bottom and side walls.

15. The method of claim 1 in which the at least one drive motor is powered by a battery.

16. The method of claim 1, in which the pool cleaner further includes a pump discharge stream having a force vector that is normal to the surface on which the pool cleaner is positioned and the pump is operated continuously during the cleaning cycle.

17. The method of claim 1 in which the pool cleaner further includes a signal-generating orientation sensor that is activated when the pool cleaner moves from a substantially horizontal orientation to an angle of about 70° or more at either end, and the method includes:

propelling the pool cleaner for a predetermined period of time in response to a signal indicating that the pool cleaner is ascending a side wall, terminating the pool cleaner's movement after the predetermined period of time, and reversing the direction of movement to cause the pool cleaner to descend the wall along an angularly displaced path from that in which the pool cleaner ascended the wall.

* * * * *